United States Patent [19]

Snyder

[11] 4,248,492

[45] Feb. 3, 1981

[54] ELECTRICAL CONNECTOR ASSEMBLY HAVING MEANS FOR SHIELDING AGAINST ELECTROMAGNETIC INTERFERENCE

[75] Inventor: Gene L. Snyder, Bainbridge, N.Y.

[73] Assignee: The Bendix Corporation, Southfield, Mich.

[21] Appl. No.: 71,461

[22] Filed: Aug. 31, 1979

[51] Int. Cl.[3] ..... H01R 13/625

[52] U.S. Cl. ..... 339/89 M; 339/90 R; 339/143 R

[58] Field of Search ..... 339/89, 90, 143

[56] References Cited

U.S. PATENT DOCUMENTS

| | | | |
|---|---|---|---|
| 2,762,025 | 9/1956 | Melcher | 339/89 C |
| 3,521,222 | 7/1970 | Andrews | 339/143 R |
| 3,678,445 | 7/1972 | Brancaleone | 339/143 R |
| 3,835,443 | 9/1974 | Arnold et al. | 339/90 R |

*Primary Examiner*—John McQuade

*Attorney, Agent, or Firm*—William G. Kratz, Jr.; C. Dennis Lacina; Raymond J. Eifler

[57] ABSTRACT

An electrical connector assembly, wherein contacts contained therein are shielded from electromagnetic interference. A coupling nut 300 unites a first metal shell 100 having a flange 140 thereabout, with the flange 140 having a first groove 180 formed in the face thereof, and a cooperating groove 190 formed about the periphery of the front section of the shell 100, and a second metal shell 200 having an end wall 220. A metal to metal contact is assured between the flange 140 of the first shell 100 and the end wall 220 of the second shell by means of a resilient metal strap 500 positioned with said grooves, with the leg portion 510 in first groove 180 in contact with the end wall 220 and the stem portion 520 situated in cooperating groove 190 contacting the front section of the first shell 100 and front section of the second shell 200. The strap 500 is preferably formed with grooves 530 therein, adjacent grooves 530 extending from opposite sides of the strap to give the strap 500 a sinuous shape.

8 Claims, 5 Drawing Figures

ELECTRICAL CONNECTOR ASSEMBLY HAVING MEANS FOR SHIELDING AGAINST ELECTROMAGNETIC INTERFERENCE

BACKGROUND OF THE INVENTION

The present invention is an electrical connector assembly having a pair of shells interconnected by a coupling nut wherein an effective electromagnetic interference shield is provided to protect the contacts contained within the assembly from external electromagnetic interference.

As an example of the type of electrical connector assemblies to which the present invention may be applied, attention is drawn to U.S. Pat. No. 4,109,990 which is assigned to the assignee of the present invention, and which is incorporated by reference herein. In that patent, an anti-decoupling mechanism is described for use with a connector assembly formed from a first metal shell containing socket type contacts within an insert, a second metal shell containing pin type contacts within an insert, these contacts matable, and a coupling ring which maintains the two shells and the contacts contained therein in a mated relationship.

In such electrical contact assemblies, the first metal shell generally has a flange thereabout against which the end wall of the second shell will abut when the assembly is united. A problem exists, however, in such assemblies in that unless the end wall of the second shell and flange of the first shell are in metal to metal contact, a leakage path may result and the contacts within the interior of the connectors may be subjected to electromagnetic interference. Such interference, often designated EMI, is that electromagnetic energy which interrupts, obstructs or otherwise degrades or limits effective performance of telecommunications equipment or subsystems. While the use of very close tolerances is attempted in order to assure metal to metal contact of the flange of the first shell with the end wall of the second shell, due to the accumulation of tolerance, such contact can seldom be definitely obtained and a gap therebetween will result, which gap will increase within the tolerance accumulation range, and which gap is a potential electromagnetic leakage path.

It is an object of the present invention to provide an electrical connector assembly that is formed of a minimum number of parts and readily manufactured and which assures metal to metal contact between the shells of the connector to preclude electromagnetic interference with the contacts contained therein.

SUMMARY OF THE INVENTION

The present invention relates to an electrical connector assembly 10, characterized by a coupling nut 300 which unites a first metal shell 100 and a second metal shell 200, the shells containing inserts enclosing electrical contacts 170 and 270 and means for assuring against electromagnetic interference to said contacts. The first shell 100 has a flange 140 thereabout, a face 160 of the flange having a first channel 180 therein, and a cooperating channel 190 is provided about the periphery of the front section of first shell 100 adjacent the front section of the second shell 200. A metallic strap 500 of L-shaped configuration is situated in the channels 180 and 190, the leg portion 510 thereof situated in first channel 180 and the stem portion 520 thereof situated in cooperating channel 190, which metallic strap preferably has slots 530 therein to enable a flexing of the strap 500.

DETAILED DESCRIPTION

Figure 1:
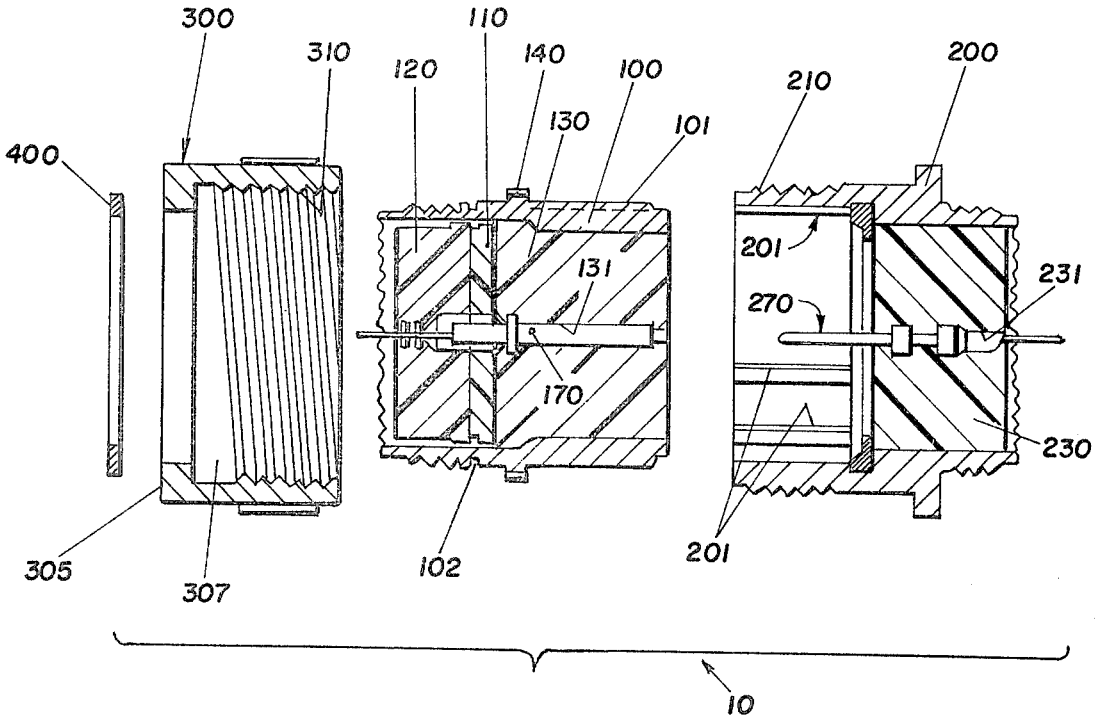
FIG. 1 is a cut-away view of the main portions of a connector assembly of the present invention.

Referring now to the drawings, an electrical connector assembly 10 according to the present invention is illustrated, which includes a first shell 100, a second shell 200 and a coupling nut 300 that is mounted on the first shell 100 for connecting the first shell 100 and the second shell 200 in mating relationship. Typical components of the first shell 100 include one or more female type (socket) electrical contacts 170 retained within the shell 100 by inserts 110, 120 and 130. The outer surface of the first shell 100 includes one or more keys 101 for orienting the first shell 100 relative to the second shell 200. The contacts 170 are mounted within passages 131 through the inserts. The shell 100 includes a flange 140 which extends around the outer periphery thereof.

Typical components of the second shell 200 include one or more axially extending recesses or keyways 201 for receiving the respective keys 101 on the first shell 100. The second shell includes one or more male type (pin) electrical contacts 270 that mate with the socket type contacts 170 of the first shell. These contacts 270 are retained in the second shell 200 by one or more inserts 230. The inserts 230 include a passage 231 along with means for retaining the contacts within the passage. The shell 200 includes a forward external thread 210 or other securing means.

Figure 2:
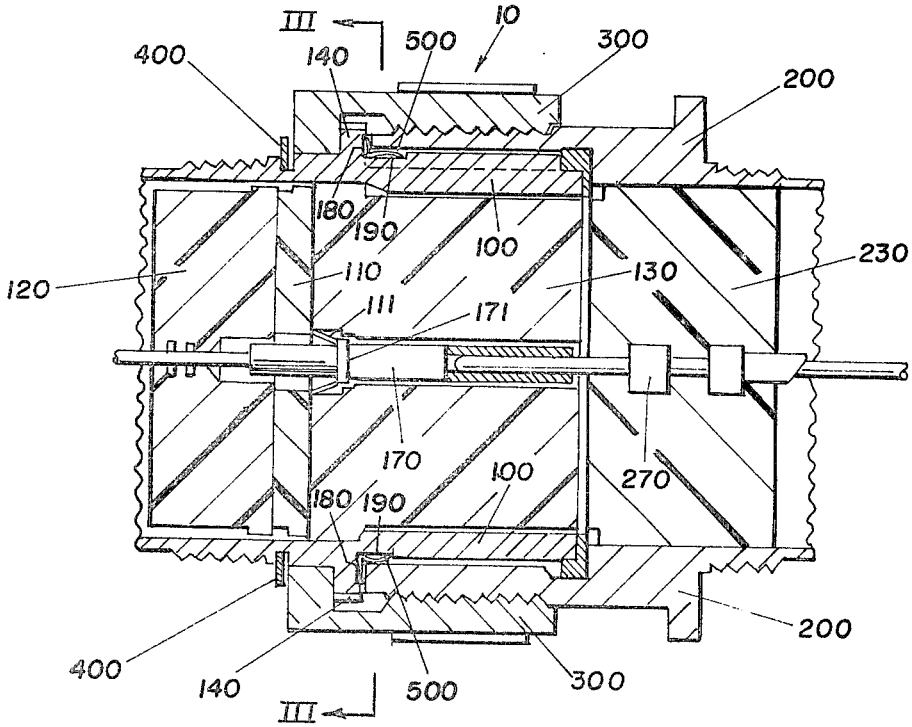
FIG. 2 is a cross-sectional view of a connector assembly of the present invention showing the shells and coupling ring in mated position.
Figure 3:
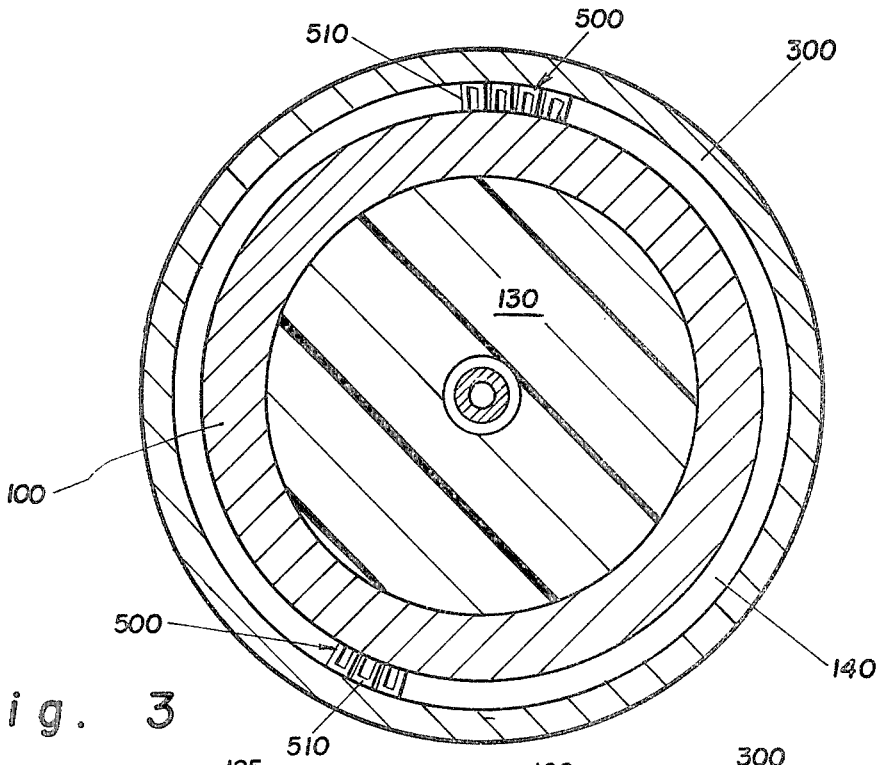
FIG. 3 is a view taken along the lines III—III of FIG. 2.
Figure 4:
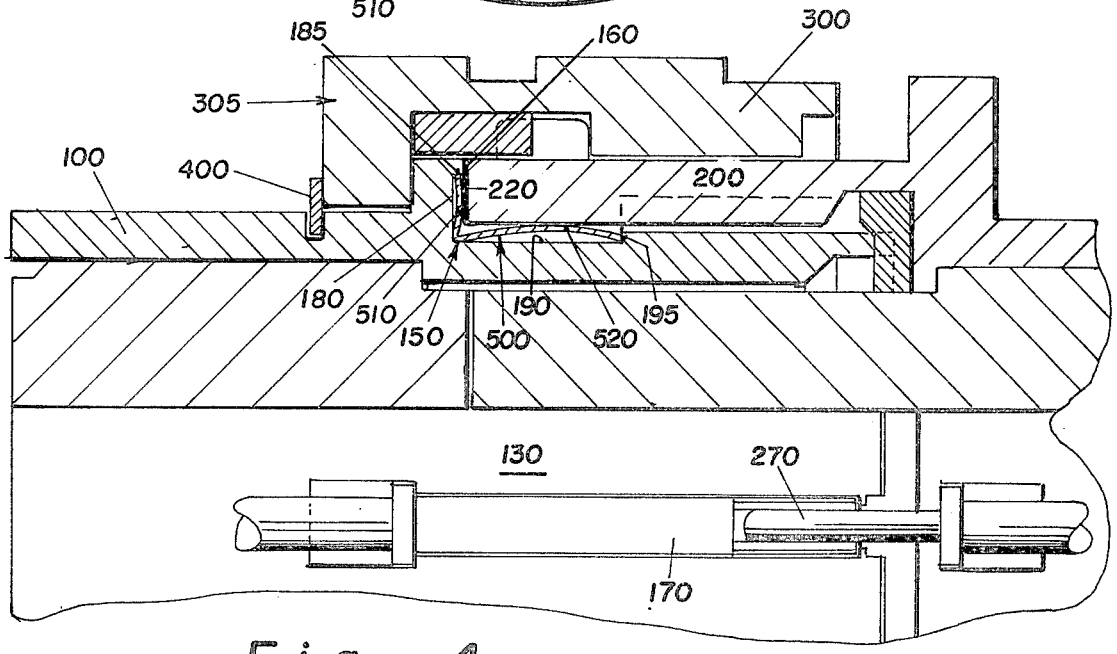
FIG. 4 is an enlarged view of the upper portion of the assembly of FIG. 2, using a bayonet type rather than screw type securement, showing the relationship of the flange of the first shell, end wall of the second shell and the placement of the metallic strap.
Figure 5:
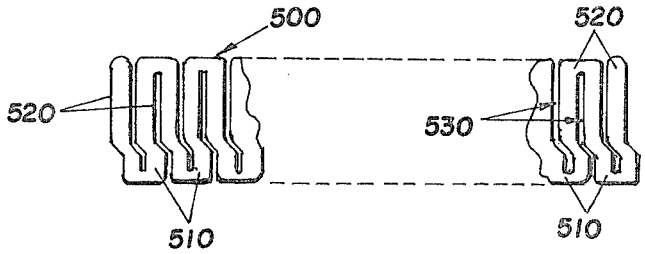
FIG. 5 is a plan view with cut-away portions of the metallic strap usable in the connector assembly.

The coupling nut 300 is mounted over the rear section of the first shell 100, with internal threads 310, or other securing means, on the coupling nut adapted to mate with the external threads 210, or other securing means, on the second shell to bring the first and second shells together with the contacts mated. The coupling nut 300 is rotatably mounted on the first shell 100 by a snap ring 400, that is snapped into a groove 102 in the first shell 100, thus retaining the end wall 305 of the coupling nut 300 between the ring 400 and the flange 140. When so mated, the end wall 220 of the second shell 200 should abut the wall 160 of the flange 140 of the first shell 100. The assembly of FIGS. 1 and 2 illustrate a conventional screw type securement, while FIG. 4 illustrates the invention in association with a conventional bayonet type securing means connector assembly construction.

Upon mating of the first shell 100 with the second shell 200, by means of the coupling nut 300, there must be established a metal to metal shield, by contact of the end wall 220 with the wall 160 of flange 140, or electromagnetic interference can result due to leakage through any gap between those two walls 220 and 160. The present invention provides means for assuring metal to metal contact in this area.

The means for assuring metal to metal contact comprise a first channel 180 formed in the wall 160 of flange 140 on the first shell 100, a cooperating second channel 190 formed about the front section of the first shell 100, and a resilient metallic member 500 situated within said channels in contact with both the first shell 100 and end wall 220 of the second shell 200. As illustrated in FIG. 4, the flange 140 has a first channel 180 formed in the face 160 of the flange 140, which channel extends from corner 150 at its inner portion to a first retention wall 185 at its outer portion. A cooperating channel 190 is formed about the periphery of the front section of the first shell 100, adjacent the front section of the second shell 200 which terminates as end wall 220. The cooperating channel 190 extends from corner 150 at its front portion to a second retention wall 195 spaced therefrom.

A resilient metallic member 500 is provided, which is preferably in the shape of an L-shaped metallic strap, the strap having a bowed leg portion 510 and a bowed stem portion 520. The metallic strap 500 is preferably constructed such that slots 530 are cut therein, with adjacent slots 530 cut from opposite sides of the strap 500 to form a sinuous pattern for the strap. The metallic strap 500 is situated in the assembly such that the leg portion 510 thereof is contained between the corner 150 and first retention wall 185 of the channel 180 formed in wall 160 of flange 140 of shell 100, while the stem portion 520 is contained between the corner 150 and second retention wall 195 of cooperating channel 190 about the periphery of the first shell 100.

The resilient metal strap 500 is formed from a highly conductive metallic material or a conductively plated metallic material, with beryllium copper a preferred material. The resilient metallic strap 500 is preferably fabricated from flat spring stock and formed to fit about the outer periphery of the front section of the shell 100 within groove 190. The use of the slots 530 to form the strap 500 in a sinuous shape enables the strap to flex and open sufficiently to enable the strap to fit over the keys 101 on the first shell 100 and still return to a tight fit about the groove 190 in shell 100 after assembly.

In forming the connector assembly, the strap 500 is passed over the keys 101 and the periphery of the first shell 100 and the stem portion 520 situated within the cooperating groove 190, with the leg portion 510 in the channel 180 of the flange 140. The coupling nut 300 is then fitted over the first shell 100 and rotatably secured thereto by means of the snap ring 400. Upon mating of the second shell 200 therewith, the end wall will compress the bowed stem portion 520, forcing the leg portion 510 to flex towards the end wall 220 of second shell 200. At the fully mated position, the leg portion 510 is forced into the channel 180, tensioning the stem portion 520. Under such tension, the leg portion 510 will be constantly flexed towards end wall 220 of the second shell 200 and will provide continuous metal to metal contact between the flange 140, through channel 180, even if built-up tolerances, vibrations, or the like, would cause a small gap to form between face 160 of the flange 140 and the end wall 220 of the second shell 200. A continuous shield is thus provided to prevent access of electromagnetic interference to the contacts contained within the electrical connector assembly.

What is claimed is:

1. In an electrical connector assembly comprising:

a first metal shell having a flange thereabout and mounting therein an insulative insert having a plurality of axial passages;

a second metal shell mounting therein an insulative insert having a plurality of axial passages, said second shell including a securable portion and a front section terminating as an end wall;

a plurality of pin type and socket type electrical contacts, each of said pin type electrical contacts being mounted in a respective axial passage of one of said inserts, each of said socket type electrical contacts being mounted in the other of said inserts and arranged in the same manner as the pin type electrical contacts are arranged in the one insert whereby respective of the contacts are mateable;

a coupling nut for selectively connecting and maintaining said first and second shells together in the mated position, said coupling nut being mounted on said first shell and including means connectable with the securable portion on the second shell for connecting the first and second shells together with the pin type and socket type electrical contacts held in mated relationship;

the improvement comprising means assuring metal to metal contact between the flange of the first shell and the front section of the second shell for shielding the electrical contacts from electromagnetic interference, said shielding means comprising a first channel formed in the wall of the flange of said first shell adjacent the end wall of the second shell and a cooperating channel about the front section of the first shell adjacent the front section of the second shell; and a resilient metallic member situated within said channels in contact with the first shell and with the end wall of the front section of the second shell, said metallic member has slots cut therein with adjacent slots extending from opposite sides of the metallic member to form a sinuous pattern.

2. An electrical connector assembly as defined in claim 1 wherein the first channel and the cooperating channel extend completely around the flange on the first shell and the front section of the first shell.

3. An electrical connector assembly as defined in claim 2 wherein said resilient metallic member is situated completely about said channels.

4. An electrical connector assembly as defined in claim 1 wherein said metallic member comprises a strap of metal having an L-shaped cross-section.

5. An electrical connector assembly as defined in claim 4 wherein the leg of said L-shaped member is situated in the first channel and the stem of said L-shaped member is situated in the cooperating channel in the front section of the first shell.

6. An electrical connector assembly as defined in claim 5 wherein said L-shaped member is formed from a beryllium copper material.

7. In an electrical connector assembly comprising:

a first metal shell having an insert, with a plurality of axial passages, and a flange thereabout;

a second metal shell having an insert, with a plurality of axial passages, said second shell having securing means on a portion thereof and a front section terminating as an end wall;

a plurality of pin type and socket type electrical contacts, each of said pin type electrical contacts being mounted in a respective axial passage of one of said inserts, each of said socket type electrical contacts being mounted in the other of said inserts and arranged in the same manner as the pin type electrical contacts are arranged in the one insert whereby respective of the contacts are mateable;

a coupling nut for selectively connecting and maintaining said first and second shells together in the mated position, said coupling nut being mounted on said first shell and including means connectable with the securing means on the second shell for connecting the first and second shells together with the pin type and socket type electrical contacts held in mated relationship;

the improvement comprising means for assuring contact between the flange of the first shell and the front section of the second shell, said contact means comprising a first channel formed in the wall of the flange of said first shell adjacent the end wall of the second shell and a cooperating channel about the front section of the first shell adjacent the front section of the second shell; and a resilient metallic member comprising a strap of metal having an L-shaped cross-section, wherein the leg of said strap is situated in the first channel and the stem thereof situated in the cooperating channel in the front section of the first shell, wherein said leg and stem are bowed in the direction of the second shell wherein said strap of metal has slots cut therein with adjacent slots extending from opposite sides of the strap to form a sinuous pattern for said strap.

8. An electrical connector assembly as defined in claim 7 wherein said first channel is formed completely about said flange and said cooperating channel is formed completely about the front section of the first shell, and wherein said strap is situated completely about said channels.

* * * * *